US009863731B1

(12) United States Patent
Alderman

(10) Patent No.: US 9,863,731 B1
(45) Date of Patent: Jan. 9, 2018

(54) TRIGGER CONTROL ASSISTANCE DEVICE FOR A NON-FULLY AUTOMATIC FIREARM

(71) Applicant: Robert Joe Alderman, Poteet, TX (US)

(72) Inventor: Robert Joe Alderman, Poteet, TX (US)

( * ) Notice: Subject to any disclaimer, the term of this patent is extended or adjusted under 35 U.S.C. 154(b) by 0 days.

(21) Appl. No.: 15/685,333

(22) Filed: Aug. 24, 2017

Related U.S. Application Data

(63) Continuation-in-part of application No. 15/590,291, filed on May 9, 2017, which is a continuation of application No. 14/658,384, filed on Mar. 16, 2015, now Pat. No. 9,644,915.

(60) Provisional application No. 61/967,364, filed on Mar. 18, 2014.

(51) Int. Cl.
*F41A 19/59* (2006.01)
*F41A 19/09* (2006.01)

(52) U.S. Cl.
CPC ..... *F41A 19/59* (2013.01); *F41A 19/09* (2013.01)

(58) Field of Classification Search
CPC ..... F41A 19/59; F41A 19/58; F41A 19/09; F41A 19/08
USPC ..... 42/90, 69.01, 69.02, 1.02, 1.03, 1.04
See application file for complete search history.

(56) References Cited

U.S. PATENT DOCUMENTS 348,868 A * 9/1886 Straube ..... F41A 19/10 188/368
2,589,227 A * 3/1952 Colley ..... F41A 19/09 42/69.01
3,141,254 A * 7/1964 Savioli ..... F41A 19/09 42/70.06
3,828,458 A * 8/1974 Skone-Palmer ..... F41A 19/56 42/106
4,718,187 A * 1/1988 Blake ..... F41A 19/59 42/84
5,005,307 A * 4/1991 Horne ..... F41A 9/62 42/1.02
5,034,686 A * 7/1991 Aspelin ..... F41G 7/001 102/206
5,083,392 A * 1/1992 Bookstaber ..... F41A 17/06 42/84
5,727,538 A * 3/1998 Ellis ..... F41B 11/52 124/32
6,142,137 A * 11/2000 MacLaughlin ..... F41A 19/64 124/32
6,286,242 B1 * 9/2001 Klebes ..... F41A 17/066 42/70.01
6,615,814 B1 * 9/2003 Rice ..... F41A 17/06 124/71

(Continued)

*Primary Examiner* — Joshua E Freeman
(74) *Attorney, Agent, or Firm* — Law Office of William F. Ryann; William F. Ryann, Esq.

(57) ABSTRACT

A trigger control assistance device that allows a firearm user to focus on pulling a trigger without concern over trigger release. That is, a finger extension is provided to interface the user's finger during firing of the firearm. The extension is configured to reciprocatingly displace the user's finger from the trigger at a controlled rate. This, in turn provides enhanced control for the user who may now focus on aiming and pulling the trigger without undue concern over releasing the trigger. Added features such as an adjustable rate of fire and GPS enabling and disabling of the firearm may also be incorporated into the trigger control assistance device.

20 Claims, 7 Drawing Sheets

(56) References Cited

U.S. PATENT DOCUMENTS

| | | | | |
|---|---|---|---|---|
| 6,650,283 | B2 * | 11/2003 | Brydges | G01S 5/0027 340/426.19 |
| 6,715,395 | B1 * | 4/2004 | Heibel | F41A 19/58 180/287 |
| 6,766,794 | B1 * | 7/2004 | Bently | F41B 5/1469 124/32 |
| 8,857,312 | B2 * | 10/2014 | Nelson | F41A 19/08 89/27.3 |
| 9,644,915 | B2 * | 5/2017 | Alderman | F41A 19/59 |
| 2006/0101694 | A1 * | 5/2006 | Matteson | F41A 17/06 42/69.01 |
| 2007/0186457 | A1 * | 8/2007 | Pitt | F41A 17/06 42/70.06 |
| 2008/0115660 | A1 * | 5/2008 | Hensel | F41A 19/08 89/136 |
| 2008/0121097 | A1 * | 5/2008 | Rudakevych | F41A 19/58 89/28.05 |
| 2009/0158922 | A1 * | 6/2009 | Werner | F41A 19/08 89/136 |
| 2011/0259183 | A1 * | 10/2011 | Compton | F41A 19/59 89/28.1 |
| 2013/0145670 | A1 * | 6/2013 | Kuhlman | F41A 19/59 42/84 |
| 2014/0202058 | A1 * | 7/2014 | Zhou | F41A 17/063 42/70.11 |
| 2014/0378088 | A1 * | 12/2014 | Goel | F41A 17/063 455/404.2 |
| 2015/0108215 | A1 * | 4/2015 | Ehrlich | G01S 17/88 235/404 |
| 2015/0253093 | A1 * | 9/2015 | Allan | F41A 17/46 42/70.06 |
| 2015/0267992 | A1 * | 9/2015 | Alderman | F41A 19/09 42/90 |
| 2017/0199001 | A1 * | 7/2017 | Bair | F41A 19/09 |

* cited by examiner

TRIGGER CONTROL ASSISTANCE DEVICE FOR A NON-FULLY AUTOMATIC FIREARM

PRIORITY CLAIM/CROSS REFERENCE TO RELATED APPLICATION(S)

This Patent Document is a Continuation-In-Part claiming priority under 35 U.S.C. §120 to U.S. application Ser. No. 15/590,291 filed May 9, 2017, and entitled, "Trigger Assist Module for a Non-Fully Automatic Firearm" which claims priority to U.S. application Ser. No. 14/658,384, now U.S. Pat. No. 9,644,915, filed Mar. 16, 2015, and also entitled, "Trigger Assist Module for a Non-Fully Automatic Firearm", which in turn claims priority under 35 U.S.C. §119 61/967,364, filed Mar. 18, 2014, and entitled, "Trigger Pull Assist", each of which are incorporated herein by reference in their entireties.

BACKGROUND

Firearms, or portable guns that may be carried, generally by a single individual, have been available for several centuries. However, in the last hundred years or so, a transition has taken place from cumbersome muzzle loaded firearms to those which may generally be referred to as "self-loading". For example, the multiple chambered cylinder of a handheld revolver may be loaded with several rounds of ammunition at a single point in time. Subsequently, as the trigger of the revolver is pulled for sake of firing an initial round, the cylinder may simultaneously be rotated for "self-loading" of the next round to be fired. As a result, so long as the cylinder still contains unspent rounds, the user need not stop between firing shots in order to reload as would be the case with a muzzle loaded firearm. However, the conventional revolver does have some aspects that are less than user-friendly when the gun is put into actual use. For example, because the pull of the trigger must provide the energy sufficient for both recoiling of the hammer or firing pin and also for the rotation of the self-loading cylinder, the gun is often somewhat heavier or more difficult to control.

With the cumbersome nature of both muzzle loaded guns and revolvers in mind, more user-friendly semi-automatic firearms are often utilized. Like a revolver, a semi-automatic firearm is a self-loading firearm that is not fully automatic. That is, while self-loading, both a revolver and a semi-automatic firearm would not be considered "self-triggering" as discussed further below. The semi-automatic firearm, however, does have user-friendly advantages in that a spring loaded magazine may be utilized to provide the energy for the "self-loading" of subsequent rounds. That is, as opposed to relying on the user's hand strength in pulling the trigger to rotate a cylinder for sake of loading subsequent rounds, the energy for reloading of the semi-automatic is supplied by a spring in a magazine which houses subsequent rounds. Thus, once a round is fired and space for the next round is available, the spring of the magazine will "self-load" the next round.

The semi-automatic firearm does provide some user-friendly and control advantages which in certain respects may render the firearm a bit safer. However, certain challenges remain. Indeed, even in looking at the simple task of pulling a trigger, the opportunity for human error remains. This is particularly true where the user repeatedly pulls and releases the trigger for firing multiple rounds. Also, consider that, as a matter of physiology, users untrained in the use of firearms often display a tendency to move the gun slightly in the direction of the hand pulling the trigger as the gun is being fired. Of course, given that this is a firearm, missing a target for this reason could be of disastrous consequences. Once more, for a person that is handicapped or otherwise compromised in terms of manual abilities, the act of pulling a trigger may be impossible or of enhanced danger if attempted. Furthermore, for many manually compromised persons, maintaining control while repeatedly pulling and releasing the trigger is a challenge even where the act of pulling the trigger alone is not necessarily problematic in and of itself.

These challenges are not ones that might be addressed by way of utilizing a fully automatic firearm which does not really address the issue of control. For example, as multiple rounds are fired from a fully automatic firearm, the energy for firing each subsequent round is supplied by the charge of the prior fired round. As a practical matter, this means that the user does not have the ability to control the rate at which the rounds are fired. Often times the user has quickly spent an uncertain amount of ammunition in a manner that has no more control in terms of accuracy than that found in the use of a non-fully automatic firearm. In fact, due to the uncontrolled rate at which rounds are fired, the hazards involved have only increased without ever addressing potential issues a user may face in terms of control.

SUMMARY

A trigger control assistance device for a non-fully automatic firearm is disclosed. The device includes a finger extension with a face aligned with a trigger of the firearm to interface with a user's finger. A motor coupled to the extension is provided to reciprocatingly drive the extension in an axial direction and displace the user's finger away from the trigger upon firing the firearm. A processor, power source and actuator may also be incorporated into the device.

BRIEF DESCRIPTION OF THE DRAWINGS

Implementations of various structure and techniques will hereafter be described with reference to the accompanying drawings. It should be understood, however, that these drawings are illustrative and not meant to limit the scope of claimed embodiments.

DETAILED DESCRIPTION

Embodiments are described with reference to a trigger control assistance device that is utilized with a semi-automatic firearm. Specifically, the embodiments depict a device employed with a conventional M15. However, a variety of other semi-automatic firearms may be utilized with embodiments of trigger control assistance devices as detailed herein. Indeed, even a revolver, which would not be classified as any type of semi-automatic firearm, may be utilized with such devices. So long as the firearm is non-fully automatic, with a trigger pull required for each round fired, a controlled rate of firing may be achieved through use of the assist module and appreciable benefit may be realized. Additionally, embodiments detailed herein do not alter the underlying functionalities of non-fully automatic firearms. However, they do allow for a more controlled, and by extension, safer firing of the firearm.

Figure 1:
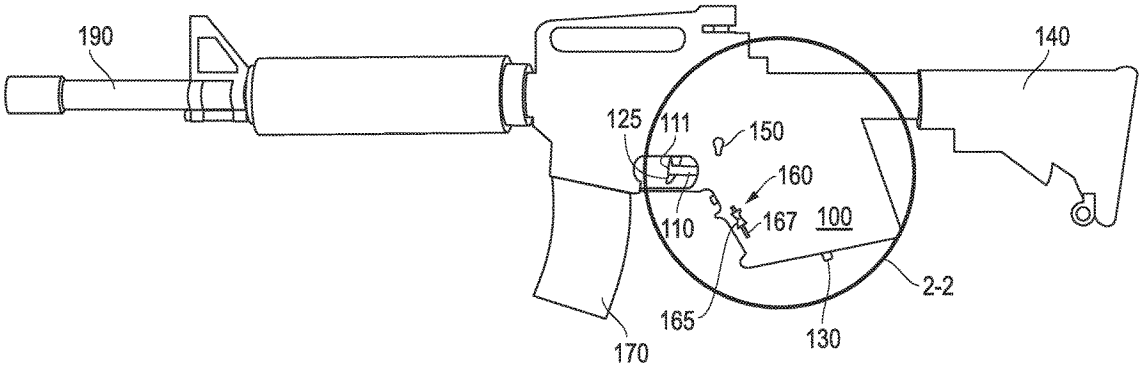
FIG. 1 is a side view of an embodiment of a firearm incorporating an embodiment of a trigger control assistance device.

Referring now to FIG. 1, a side view of an embodiment of a trigger control assistance device 100 is shown incorporated into a non-fully automatic firearm. Of course, the device 100 may also be provided in modular form for securing to a firearm (see FIG. 3). Regardless, a component in the form of a finger extension 110 may interface a user's finger as the user engages a trigger 125 of the firearm. As detailed below, the simultaneous engagement of the trigger 125 and a face 111 of the extension 110 may provide trigger control assistance for the user. The extension 110 may be a small rod or other appropriate device of suitable size, morphology and durability for the task of pushing the user's finger away from the trigger after each round is fired. In this way, the user does not need to direct releasing of his or her finger from the trigger 125 but may instead continually squeeze. Thus, the user is provided with an additional measure of trigger control assistance. This may be particularly beneficial for those of physical limitations where maintaining control while repeatedly pulling and releasing a conventional trigger is difficult. Therefore, in the embodiment shown, the extension 110 and face 111 may perform the release function for the user, allowing him or her to focus solely on trigger pulling.

In the embodiment shown, the trigger control assistance device 100 is also outfitted with an arming switch 130. Thus, a user may turn on or "arm" the device 100 by deflecting or positioning the switch 130 to an armed position. Requiring arming in this manner may help to prevent any accidental firing by the device 100. Specifically, the arming of the device 100 may allow for the user to effectively pull the trigger 125 and begin reciprocation of the finger extension 110 as detailed further below. In this way, the user may be provided with controlled trigger assistance if the device 100 is secured to the firearm with the face 111 of the extension 110 properly engaged by the user along with the trigger 125.

Figure 2:
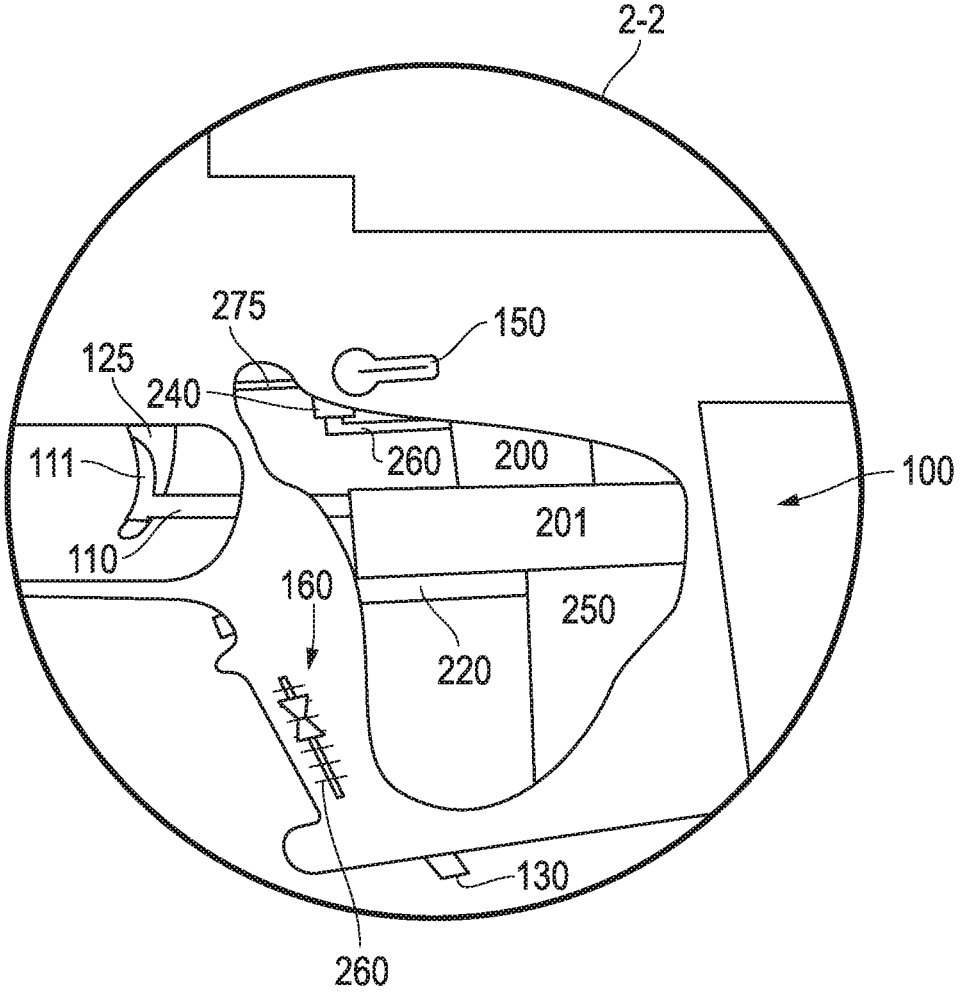
FIG. 2 is an enlarged partially sectional view of an embodiment of the trigger control assistance device of the firearm of FIG. 1.
Figure 5:
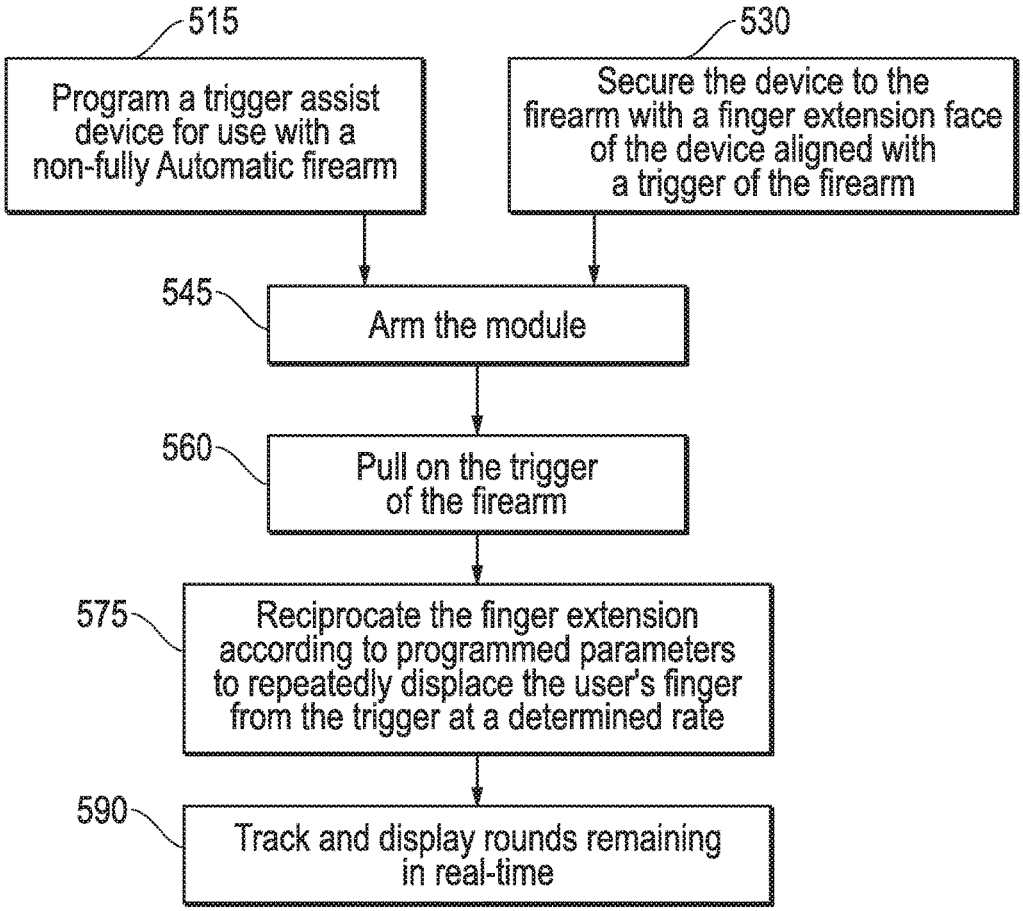
FIG. 5 is a flow-chart summarizing an embodiment of utilizing a trigger control assistance device to govern firing of a non-fully automatic firearm.

Referring now to FIG. 2, an enlarged partially sectional view of the trigger control assistance device 100 of FIG. 1 is shown. In this depiction, a control unit 250 is shown which houses a processor 500 as shown in FIG. 5 that is used to direct the reciprocation of the finger extension 110. Thus, with added reference to FIGS. 1 and 3, not only may instructions be stored for directing the reciprocations, but tracking of the reciprocations may also be recorded. Specifically, real-time tracking of the number of rounds fired or remaining may be available to the user at all times. For example, in one embodiment, the number of rounds remaining in a given magazine 170 may be displayed and dynamically updated at a display screen 350 during use of the firearm. Of course, this information may also be conveyed to the user through alternate interface modes. For example, the information may be conveyed audibly from a speaker of the device 100, or perhaps even with a wireless transmitter via Bluetooth speakers worn by the user.

Continuing with reference to FIG. 2, in addition to the control unit 250, a motor 201 is shown for driving the above described reciprocation of the finger extension 110. As used herein, the term "motor" is meant to refer to any suitable device for driving the actuation of the finger extension 110 as indicated. This may include a solenoid motor 201 as depicted in FIG. 2 and elsewhere. However, any number of other devices of appropriate size and functionality may be utilized. Specifically, the motor 201 is capable of actuating the finger extension 110 to use a face 111 thereof to repeatedly push a user's finger away from a trigger 125 after each firing of a single round.

Figure 4:
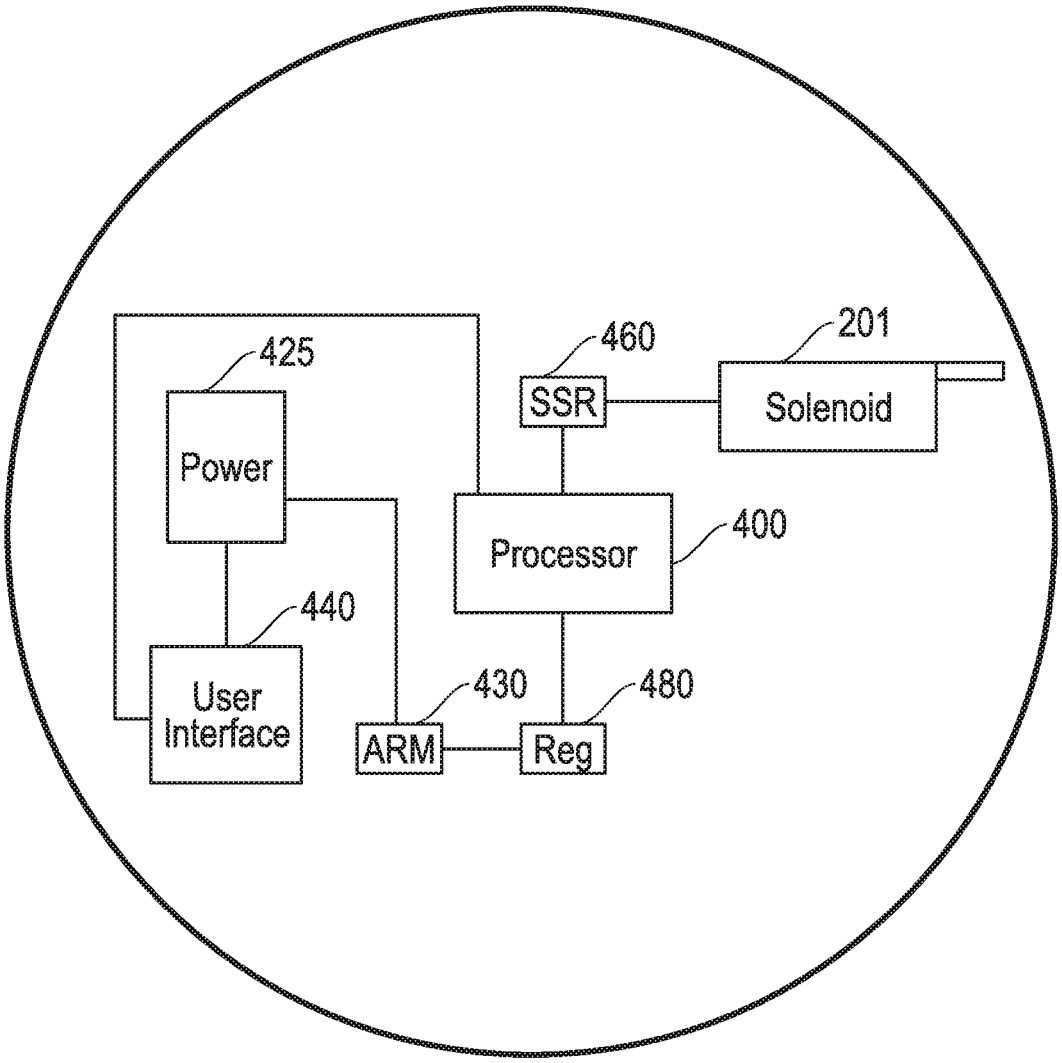
FIG. 4 is a schematic view of an embodiment of arranged electronic components for the trigger control assistance device of FIGS. 1-3.

Continuing with reference to FIGS. 1 and 2, with added reference to FIG. 4, the device 100 is also provided with a battery 425 for supplying power requirements of the solenoid motor 201, the control unit 250, the display 350 and any other power requiring components. The battery 425 may be a lithium battery of suitable size and voltage for powering such components. Once more, in order to save power, the arming switch 130 may need to be turned to an on position before any draw on the battery 425 is made available to components of the device 100. Indeed, in one embodiment, a light or audible sound may be present whenever the device 100 is armed. Thus, the odds of accidentally leaving the device 100 armed and prone to accidental firing may be reduced along with any unnecessary drain on the battery 425.

Figure 3:
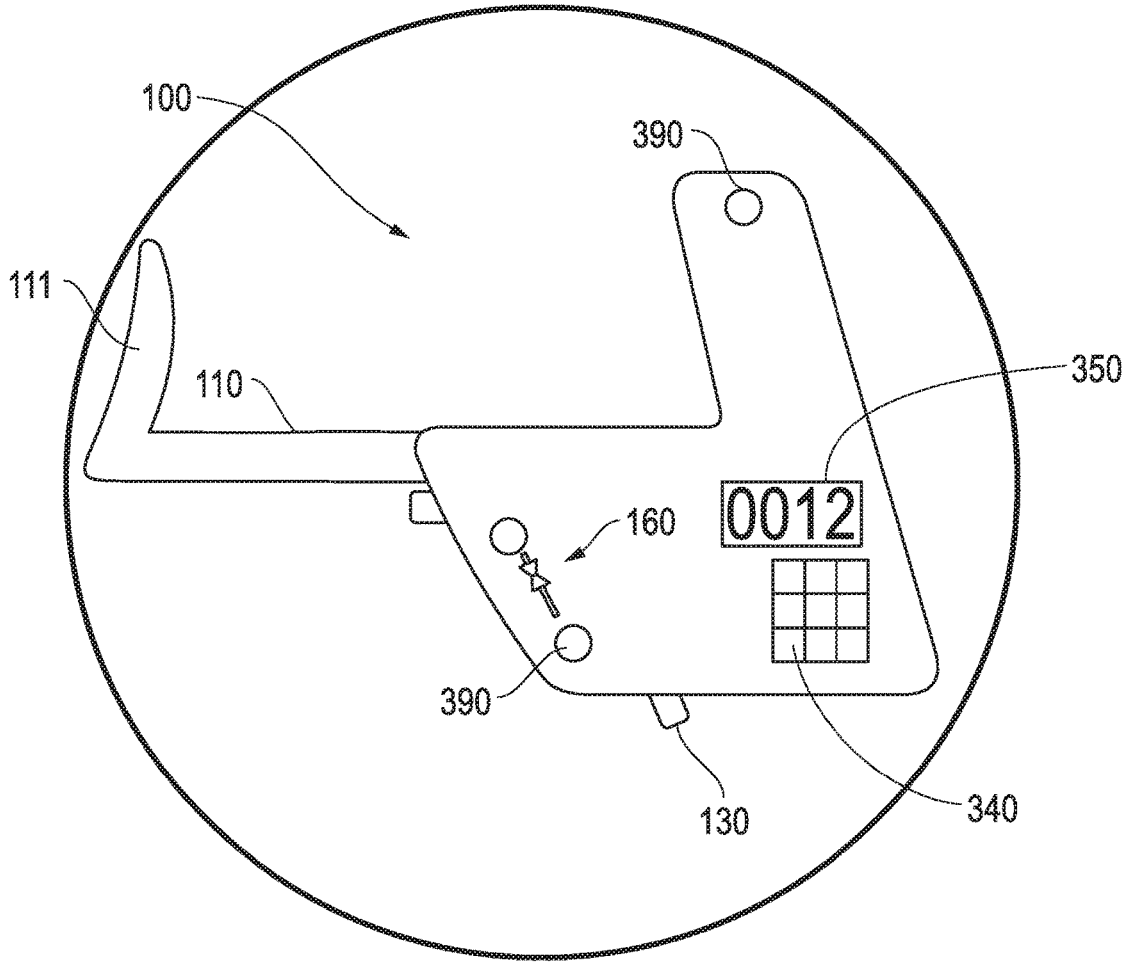
FIG. 3 is a side view of an embodiment of the trigger control assistance device of FIG. 1 in modular form.

Referring now to FIG. 3, a side view of a modular embodiment of the trigger control assistance device 100 is shown. So, for example, the firearm depicted in FIG. 1 may be a standard M15 to which a modular form of the device 100 is secured. However, as indicated above, any non-fully automatic firearm may accommodate an appropriately sized and configured embodiment of a trigger control assistance device 100, the entirety of which being self-contained together as depicted and described herein. In the view of FIG. 3, the add-on modular nature of the trigger control assistance device 100 is readily apparent. So, for example, the firearm 300 itself remains platform-free with no substantial modification required for a firearm such as an M15 to securely accommodate the device 100.

Continuing with reference to FIG. 3 the device 100 is equipped with securing implements 390 for sake of secure attachment to a firearm. In the embodiment shown, this may include the use of conventional nuts and bolts with appropriately sized and located slots at the firearm and through the body of the device 100. Of course, in other embodiments alternative types of securing implements 390 may be utilized. For example, hook and loop fasteners such as Velcro® may be utilized as well as clamps or other types of implements 390. Once more, as a practical matter, such securing implements 390, which do not result in any substantial altering of the firearm, may be of particular benefit. That is, in terms of user friendliness for the user and/or firearm manufacturers, such implements 390 do not require any substantial reconfiguring of the firearm in order to accommodate the device 100.

As discussed throughout, the device 100 is also provided with a keypad 340 and display screen 350 to serve as an interface for the user. For example, as a matter of added safety, the keypad 340 may allow the user to type in a preset arming code, without which, the arming switch 130 would remain non-functional. In other embodiments alternate types of identifying/access information may be utilized such as the use of a receiver for biometrics, voice activation or radio frequency of an electronically detectable key. More specifically, a user's fingerprint, voiced key term, or RFID tag on a bracelet, may be utilized to confirm user identity and allow for arming and use of the device 100. Additionally, as detailed further below, such modes of required identification for an authorized user of the device 100 may also be used to prevent use of the firearm, not just the device 100, in absence of such authentication. For example, the trigger 125 may be rendered immobile or inaccessible except through use of the device 100. In such circumstances, confirmation of the authorized user at the device 100 may be the only practical way to allow use of the firearm.

Continuing with reference to FIG. 3, additional information may be input through the watch face sized keypad 340 with confirmation at the display screen 350. This information may be related to the number of rounds stored in a magazine 170, programming information such as a number of reciprocations for the finger extension 110 or the rate of reciprocation and any other type of information related to use of the device 100 or firearm (see FIG. 1). With added reference to FIGS. 2 and 4, this information may be stored at a processor 400 of a control unit 250 which, in the embodiment shown, is secured at the back side of the body of the device 100.

With this simple add-on or plug-in type of mating of the device 100 to the firearm, a user may turn on the device 100 at the arming switch 130 and/or set firing parameters through the keypad 340 or other suitable interface. The firearm is now ready for firing as assisted by the reciprocation of the finger extension 110. As indicated, a countdown of remaining rounds may even be shown in real-time at the display screen 350.

Use of the device 100 to assist in displacing the user's finger from the trigger 125 provides the user with several advantages, not the least of which is improved safety and control. In contrast to a conventional fully automatic firearm, the firearm of FIG. 1 is of improved control with a single round fired for each pull of the trigger 125. This control and accuracy is enhanced by the addition of the depicted device 100. Similar to a scope that may be added on to a firearm, the device 100 also provides added accuracy and safety benefits. By way of specific example, the physiological requirement of the user to consciously repeatedly pull and release the trigger 125 is eliminated because the finger extension 110 and face 111 performs the task of displacing the finger to allow release and return of the pulled trigger 125. In circumstances where the user is handicapped or otherwise compromised in terms of manual dexterity, the elimination of this task for the user may provide for a substantially safer undertaking when repeated rounds are to be spent. By the same token, the user is unable to alter or increase the rate of fire merely through the act of pulling the trigger 125 (e.g. without consciously adjusting a switch 160 elsewhere as described below). This is because the extension 110 and face 111 perform the task of physically preventing trigger pull by the user's finger in advance of the rate set. In this respect both control and safety may be enhanced.

Continuing with reference to FIGS. 1-3, in addition to providing assistance and control for the user in firing the firearm, the device 100 also provides control over the rate or number of trigger pulls. That is, apart from the user consciously releasing the trigger 125 to stop firing, the user may continuously pull the trigger 125 and rely on a predetermined rate of finger displacement by the extension 110 and face 111 to determine the rate of fire. Once more, the rate may be preset and governed by the processor 400. However, this rate may also be consciously adjusted by a rate control switch 160. In the embodiment shown, this switch 160 may be a conventional variable resistor or potentiometer configured with a thumb interface 165 for sliding along a track 167 with pre-set click locations 260 indicative of increasing or decreasing the rate (e.g. of extension reciprocation). Thus, the user may consciously adjust the rate of fire during use. Note the relay 220 between the switch 160 and the control unit 250 which houses the processor 400 (see FIGS. 2 and 4).

This manner of control over rate of fire is in sharp contrast to a fully automatic firearm which provides no real control over rate of fire even though the user maintains constant pull on the trigger 125. Furthermore, the device 100 allows the user to focus concentration on holding sights on the target at hand during firing of the firearm without undue concern over the potentially repeating task of pulling and releasing a trigger 125. Instead, uniform, precisely timed firing is achieved by the device 100, freeing the user's focus to one of aiming.

From the user's perspective, the continual pull on the trigger 125 may be contrasted against the similar manner of operating a fully automatic firearm. However, as alluded to above, unlike a fully automatic firearm, the rate of fire may be slowed and precisely controlled. Specifically, unlike a fully automatic firearm, each new round fired with the aid of the device 100 here is fired in a manner that is unrelated to the powder charge that supported the firing of the prior round. Thus, control is not lost to the randomness and variability that is generally displayed in the explosive firings of one round to the next.

Once more, the number of, or rate of, trigger pulls may be different from user to user in terms of attaining optimum accuracy. For example, one user may generally achieve maximum accuracy with a 3 second delay between rounds of up to 5 total rounds being fired. On the other hand another user may require a longer delay of say 5 seconds but be able to maintain maximum accuracy for up to about 10 rounds being fired. Regardless, the device 100 as described allows for such personalization so that each user may optimize his or her own personal accuracy. That is, one user may program the device 100 for a firing rate of every 3 seconds for a total of 5 shots whereas another may program a firing rate of every 5 seconds for a total of 10 shots to be fired. Furthermore, the rate may be manually adjusted with the control switch 160 as described above. Along these lines, the trigger control assistance device 100 may be particularly beneficial for police and military use where training is provided in a manner that may allow each user to determine his or her own optimum firing parameters for sake of maximum accuracy when employing such bearable arms during handheld use. Furthermore, the rate may be adjusted to tailor the firing rate to the type of ammunition being utilized, for example, to avoid jamming or other firing-related failures.

Referring now to FIG. 4, a schematic view of an embodiment of arranged electronic components for the trigger control assistance device 100 of FIGS. 1-3 is shown. While these components may be arranged in a variety of ways, for sake of illustration, they are schematically shown as though at the backside of the device 100 as depicted in FIG. 2. Specifically, the solenoid motor 201 is positioned at the upper right where it might interface with the extension 110 and user interface electronics 440 are at the left (e.g. where they might interface with the keypad 340 and display screen 350 of FIG. 3).

Regardless, with added reference to FIGS. 2 and 3, these components are linked together and controlled by a control unit 250. Notably, the control unit 250 houses a processor 400 which stores and tracks a variety of different types of information pertinent to use of an associated firearm as detailed hereinabove. Furthermore, the control unit 250 also houses a solid state relay (SSR) 460 which serves as an interface between the processor 400 and the solenoid 201. Thus, actuation commands for the finger extension 110 from the processor 400 are precisely carried out by the SSR 460. As opposed to a mechanical relay, the electronic nature of the SSR 460 may render it less prone to wear over time and use.

In addition to the SSR 460, the processor 400 is also coupled to a regulator 480 and arming circuit 430. Thus, as indicated above, the device 100 may effectively be armed once the switch 130 is tripped. Further, a regulated signal indicative of a rate of fire indication from a switch 160 may be relayed to the processor 400 for responsive action.

Referring now to FIG. 5, a flow-chart is shown summarizing an embodiment of utilizing a trigger control assistance device to govern firing of a non-fully automatic firearm. Specifically, as indicated at 515 and 530, the device may be programmed with firing parameters and secured to the firearm. This programming of the device may take place before or after securing of the module to the firearm. Further, these program parameters may be tailored to the user and/or the type of firearm and may include information such as a firing rate or number of rounds to be fired. Additionally, as indicated herein, the device may be secured to the firearm in a number of ways. So long as alignment between a face of a finger extension of the device and a trigger of the firearm is stably assured, the device may be properly positioned for operation.

Once programmed and secured, the module may then be armed and ready for use as indicated at 545. Thus, continual pulling of the trigger as noted at 560 may lead to reciprocating of the module's finger extension as noted at 575. More specifically, the finger extension may reciprocate according to the programmed parameters to displace the user's finger from the trigger at a determined rate. Once more, as indicated at 590, the device may be equipped with the capacity for real-time tracking and display or otherwise relay of information regarding rounds fired or remaining.

Figure 6:
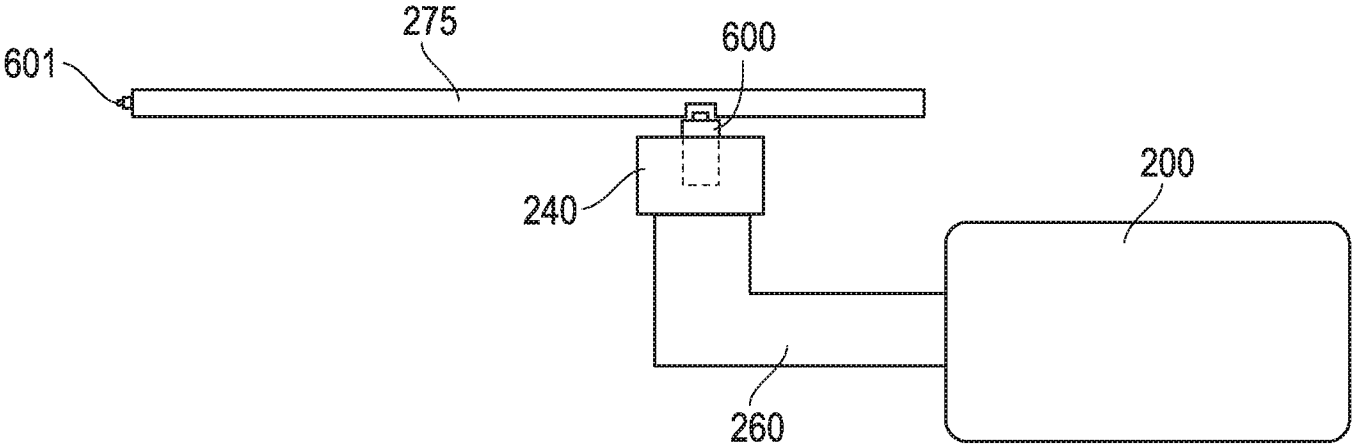
FIG. 6 is a schematic representation of an enabling and disabling assembly that may be incorporated into the module of FIG. 3 or incorporated into the device of FIGS. 1 and 2.
Figure 7:
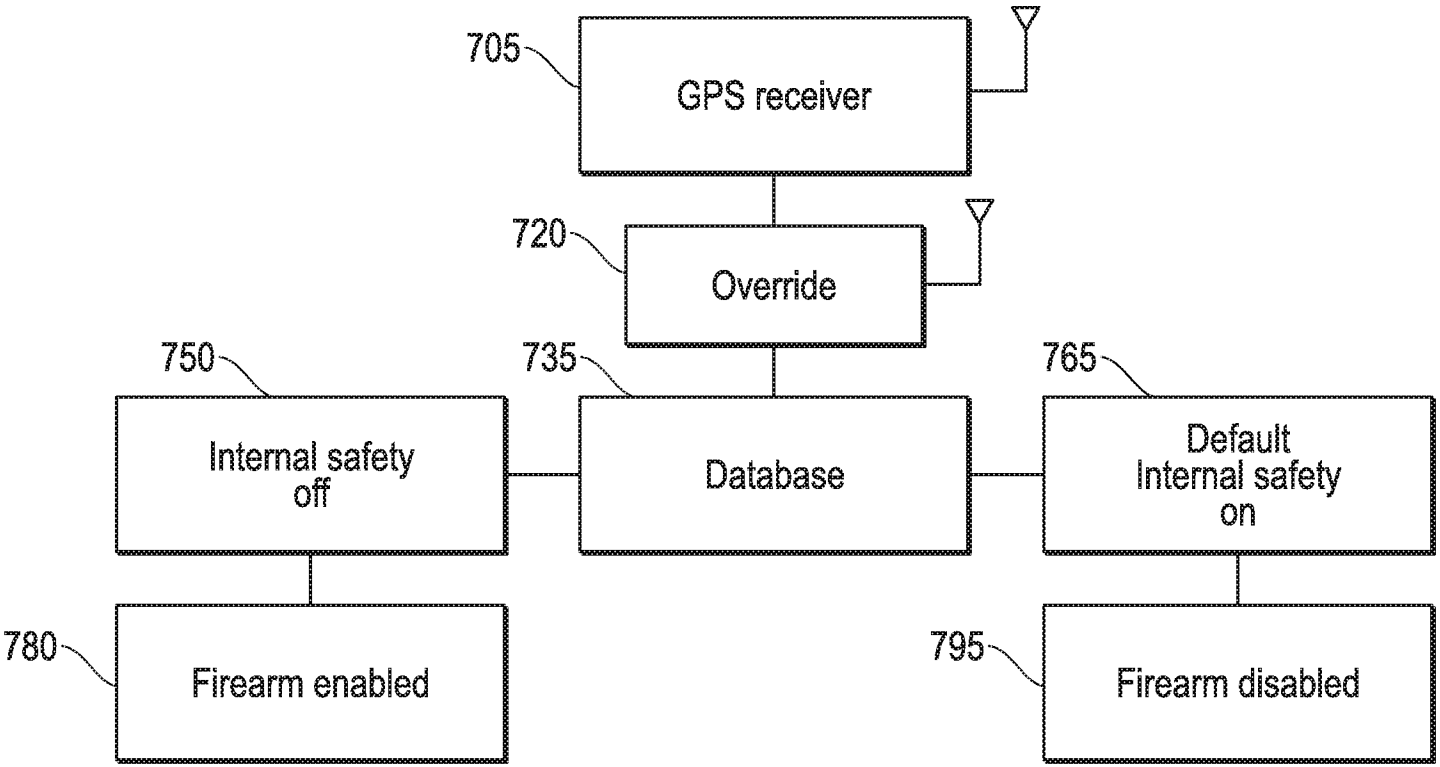
FIG. 7 is a schematic representation of remote communicative interfacing of the firearm of FIG. 1 for enabling and/or disabling thereof.

Referring now to FIGS. 6 and 7, with added reference to FIGS. 1-3, the device may have additional GPS capacity incorporated there-into. Indeed, the firearm of FIG. 1 may be thought of as a global positioning system enabled and disabled firearm. Along these lines, the assistance device 100 may further include a control system for allowing and effectuating a remote manner of enabling and/or disabling the ability of the firearm to fire a round. For example, as detailed further below with specific reference to FIG. 6, the device 100 may accommodate an implement 600 that is remotely directed to interface, by disengaging or engaging, an actuating component 275 for respectively enabling or disabling firing of the firearm. As illustrated herein, the actuating component 275 is a firing pin 600 (see FIG. 6). However, alternative actuating components may be immobilized or otherwise disabled so as to render the entire firearm disabled.

The device 100 of FIG. 1 appears to take on an appearance of some considerable bulk for sake of accommodating a control system that allows for the remote enabling or disabling of the firearm. However, this is not necessarily required. That is, such system components may be housed within a much smaller and more ergonomic housing assembly or perhaps even distributed throughout the body of a more conventionally shaped M15 or other firearm type. Along these lines, as opposed to being readily accessible by the user, the enabling and disabling system components within the device 100 (or elsewhere) are not manually accessible by the user. Instead, such components, as well as the device 100 itself, are integral with the main body of the firearm. Thus, as a practical matter, efforts to manually access or adjust these components are likely to be fruitless and result in damaging and permanently disabling the firearm.

With the integral nature of the device 100 and internal components in mind, the device 100 or other accessible location of the firearm may be outfitted with interfacing ports. For example, in one embodiment, the firearm is equipped with a port for recharging of an internal power source for enabling and disabling or other components of the firearm. Alternatively, the battery may be a replaceable feature similar to the magazine 170 noted below, and thus, located physically apart from the more integral components of the device 100. Further, in addition to electronic connections for sake of battery recharge, the same or another port may be provided for sake of providing database/processor updates. For example, as detailed further below, one component of the device 100 may be a control unit 250 with a processor that accounts for information such as location coordinates (see FIGS. 2 and 4). Thus, updating enabling and disabling parameters relative such coordinates may be achieved through such a port or alternatively in a wireless fashion.

As alluded to above, the firearm may be configured to be enabled for firing based on location coordinates such as GPS (global positioning system coordinates). That is, when the firearm is within certain pre-determined location coordinates, it may be disabled through techniques detailed below whereas when located outside of such locations, the firearm may be enabled for firing.

Referring now specifically to FIG. 6, with added reference to FIG. 2, a schematic representation of an enabling and disabling assembly of the device 100 and system of FIG. 2 is shown. In this view, the interfacing between the implement 600 and the actuating component/firing pin 275 is apparent. That is, depending on the behavior of the implement motor 240, the implement 600 may move up to $1/8^{th}$ of an inch or so to engage and immobilize the firing pin 275 and thereby disable the firearm. That is, without the ability of the firing pin head 601 to strike forward on a round of ammunition, the firearm is left unable to fire. However, depending on commands from the processor at the control unit 250, receiver 200 or elsewhere, the motor 240 may be instructed to remain disengaged from the firing pin 275 leaving the firearm enabled.

In one embodiment, the motor 240 may default to engage the implement 600 with the firing pin 601 so as to disable the firearm whenever no signal or power is detected in the system. However, when powered and equipped with a functional receiver 200, disabling of the firearm 100 may generally be dictated by location information obtained by the receiver 200 as detailed above. Alternatively though, in an embodiment where the receiver 200 or the system is equipped with transmitting capability, the firearm may be disabled based on information other than, or in addition to, location information.

In one embodiment, a transmitter of the system may be utilized to broadcast identification information regarding the firearm to a central command as noted above. However, in this embodiment, such electronic identification may be used for firearm specific enabling and disabling via remote command. That is, as opposed to location specific enabling and disabling of the firearm, a central command in communication with the receiver 200 and transmitter of the identified firearm may enable or disable the firearm. So, for example, all firearms identified as suspect due to a particular registered owner, those reported as stolen, those recently detected as firing in a given geographic area or a host of other factors, may be disabled by the appropriate policing central command.

In another embodiment, the firearm may be equipped with a default function such that the motor 240 and implement 600 disable the firearm unless an authorization signal is obtained by the receiver 200. In this embodiment, jurisdictions that seek to disable all firearms in a given region for example, when a gunman is on the loose or mass shooting is underway may automatically do so. Further, two-way communications for determining enabling and disabling of firearms may have advantages beyond policing. For example, in military circumstances, it may be desirable to disable all military personnel firearms in a given area when there is a concern that the arms have fallen into the hands of enemy combatants. Thus, detecting and disabling these firearms may be of significant benefit.

Referring now to FIG. 7, a schematic representation of one embodiment of remote communicative interfacing of the firearm of FIG. 1 is shown for enabling and/or disabling thereof. As indicated at 705 and detailed above, the firearm may be equipped with a receiver that obtains GPS location information. This GPS information may be cross-checked against stored database location information as indicated at 735. Depending on the results of this cross-check, the internal safety may be turned off as indicated at 750. For example, where the cross-check indicates that the firearm is in a location that is not classified as "forbidden", a motor and restricting implement within the firearm may disengage from a firing pin and allow enabling thereof. Thus, the firearm may shoot (see 780). On the other hand, where the cross-check reveals that the firearm is in a location that is forbidden, the internal safety of an engaged implement may be "on" (see 765) such that the firearm is disabled as noted at 795.

Continuing with reference to FIG. 7 and as described above, the "internal safety" of engagement between the restricting implement and an actuating component such as a firing pin may be on as a matter of default (see 765). More specifically, the firearm may be disabled unless location information is provided that cross-checks with the firearm being outside of a forbidden location. Thus, in circumstances of power and/or GPS or receiver failure, the firearm would be automatically disabled. Furthermore, as indicated at 720 even in circumstances where the firearm is not identified as being in a forbidden location, an override may take place for disabling the firearm, regardless. For example, as detailed above, with two way communications available, a firearm may be disabled due to theft or a variety of real-time military or policing circumstances even though the identified location is not necessarily predetermined as "forbidden".

Embodiments described hereinabove include an add-on module-type of device for a firearm that is non-fully automatic. The device components may alternatively be incorporated into the body of the firearm. Regardless, the trigger control assistance device serves as an interface for a user in controlling firing rounds of non-fully automatic firearm. Thus, the opportunity for human error is reduced. Indeed, for a person that is handicapped or otherwise compromised in terms of manual dexterity and ability, the ability to safely pull the trigger through use of the interfacing module may be of even more significant benefit. Once more, all of these benefits are achieved without the firearm being converted to a fully automatic firearm. Thus, the challenges of potential inaccuracy, reduced control and/or tracking the amount of ammunition spent during use may be substantially eliminated. Once more, the device may incorporate the added capacity for rendering a firearm as a GPS enabled and disabled firearm.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, given the electronic nature of the trigger control assistance device, one embodiment may be equipped with a pan, tilt and/or zoom camera and a receiver or other features supportive of remote non-manual actuation not requiring user pressing of the manual actuator (e.g. for police, military, sniper or other appropriate use). Once more, the control assistance provided to the user may be to use the extension 110 as an aid in pulling a trigger 125 in place of displacing the user's finger (e.g. as detailed in the parent hereof, U.S. application Ser. No. 15/590,291 or in the grandparent hereof U.S. application Ser. No. 14/658,384, now U.S. Pat. No. 9,644,915). By the same token, the embodiments detailed further herein above may also be viewed as preventing user's from firing too rapidly or increasing rate of fire. That is, the face 111 of the extension 110 not only displaces the user's finger upon pulling of the trigger 125 but it also forcibly prevents premature pull of the trigger 125, non-simultaneous with the face 111 (i.e., in advance of the set rate).

Additionally, while the firearm control system is detailed hereinabove may also have a GPS/receiver and other components entirely housed within the firearm, this is not necessarily required. Indeed, a GPS receiver and other communicative and even data storage devices of the system may be handheld or suitably sized for carrying by the user apart from the firearm. Thus, size and weight limitations of the firearm itself may be less affected by the use of the control system. Furthermore, the foregoing description should not be read as pertaining only to the precise structures described and shown in the accompanying drawings, but rather should be read as consistent with and as support for the following claims, which are to have their fullest and fairest scope.

I claim:

1. A trigger control assistance device for a platform-free, non-fully automatic firearm, the entirety of the device and firearm being user-held for operation with the device comprising:

a finger extension with a face aligned with a trigger of the firearm, the face for interfacing with a user's finger;

a motor coupled to the extension for reciprocatingly driving the extension in an axial direction to displace the user's finger away from the trigger upon firing of the firearm;

a processor coupled to the motor for directing a controlled rate of the displacement of the finger to control a rate of firing of the firearm;

a power source coupled to the motor and the processor to power the driving and the directing; and an actuator to signal the reciprocating driving of the extension.

2. The device of claim 1 wherein the processor contains information for enabling and disabling the firearm based on analysis, the device further comprising:

an actuating component for assisting in the firing of the firearm;

an implement for engaging the actuating component to effect the disabling of the firearm and for disengaging from the actuating component to effect the enabling of the firearm; and a receiver for obtaining an information signal from a remote location relative the firearm, the processor coupled to the receiver for analyzing the information signal to direct the disengaging and the engaging based on the analyzing.

3. The device of claim 2 wherein the information signal is one of global positioning system information and an instruction signal specific for one of the disabling and the enabling of the firearm.

4. The device of claim 3 wherein the processor includes a database of location coordinates for comparison against the global positioning system information for the analyzing.

5. The device of claim 1 wherein the motor is a compact electrically powered solenoid.

6. The device of claim 1 wherein the power source is a lithium battery.

7. The device of claim 1 wherein the processor is configured to manage one of preset program information and dynamically updated real-time information.

8. The device of claim 7 wherein the preset program information is one of number and rate of trigger pulls and the dynamically updated real-time information is one of rounds spent and rounds remaining.

9. The device of claim 1 further comprising a user interface selected from a group consisting of a display screen, a keypad, at least one speaker, a wireless transmitter and a receiver.

10. A non-fully automatic self-contained firearm with a trigger for pulling, the firearm for firing a single round per pulling of the trigger, the firearm incorporating a trigger control assistance device to aid in the firing, the entirety of the self-contained firearm with device manually held by a user during operation with the device comprising:

a finger extension for one of engagement with the trigger for pulling thereof for the firing and interfacing with a finger of the user for displacement thereof upon the firing;

a motor coupled to the extension for moving the extension in an axial direction to achieve the one of the pulling and the displacement;

a processor coupled to the motor for directing the moving upon manual aiming of the firearm by the user; and a battery coupled to the motor and the processor to power the moving and the directing.

11. The non-fully automatic firearm of claim 10 wherein the processor is configured with instructions for enabling and disabling the firearm based on analysis of an information signal from a remote location.

12. The firearm of claim 10 further comprising an interfacing port to support one of updating a database stored in the processor and recharging a power source.

13. The non-fully automatic firearm of claim 10 wherein the firearm is a handheld semi-automatic firearm.

14. The non-fully automatic firearm of claim 10 wherein the trigger is inaccessible to manual user actuation.

15. The non-fully automatic firearm of claim 14 wherein the inaccessibility of the trigger for manual user actuation is provided by one of an enclosed body of the module and the finger extension being substantially immobilizing relative to the trigger.

16. A method of assisting a user in controlling the firing of a non-fully automatic platform-free, user held firearm with a control assistance device coupled thereto, the method comprising:

programming a processor of a control assistance device;

simultaneously pulling a trigger of the firearm and a face of a finger extension of the device with a finger of the user; and reciprocatingly displacing the user's finger from the trigger with the face of the finger extension according to programmed parameters from the processor, the entirety of the firearm and module manually held by the user during the reciprocating.

17. The method of claim 16 wherein the processor is configured with instructions for enabling and disabling the firearm based on analysis of an information signal from a remote location.

18. The method of claim 16 wherein the reciprocating of the finger extension further comprises employing the face of the extension to forcibly prevent the pulling of the trigger non-simultaneous with the face.

19. The method of claim 16 wherein the programmed parameters include a rate of firing of the rounds, the method further comprising adjusting the rate of firing of the rounds.

20. The method of claim 19 wherein the adjusting of the rate of firing is based on one of a rate tailored to the user and a rate tailored to the round type employed by the firearm.

* * * * *